US009896846B2

(12) United States Patent
Horton

(10) Patent No.: US 9,896,846 B2
(45) Date of Patent: Feb. 20, 2018

(54) LOW SLOPE ROOFING SYSTEM

(71) Applicant: Southeastern Metals Manufacturing Company, Inc., Jacksonville, FL (US)

(72) Inventor: James W. Horton, Yulee, FL (US)

(73) Assignee: Southeastern Metals Manufacturing Company, Inc.

( * ) Notice: Subject to any disclaimer, the term of this patent is extended or adjusted under 35 U.S.C. 154(b) by 0 days.

(21) Appl. No.: 14/724,950

(22) Filed: May 29, 2015

(65) Prior Publication Data

US 2016/0177570 A1 Jun. 23, 2016

Related U.S. Application Data

(60) Provisional application No. 62/119,287, filed on Feb. 23, 2015, provisional application No. 62/093,338, filed on Dec. 17, 2014.

(51) Int. Cl.

| | |
|---|---|
| ***E04D 5/14*** | (2006.01) |
| ***E04D 3/36*** | (2006.01) |
| ***E04D 3/16*** | (2006.01) |
| ***E04D 11/02*** | (2006.01) |
| ***E04D 13/00*** | (2006.01) |
| ***E04D 15/04*** | (2006.01) |

(52) U.S. Cl.

CPC ..... *E04D 5/148* (2013.01); *E04D 3/16* (2013.01); *E04D 3/3605* (2013.01); *E04D 5/142* (2013.01); *E04D 5/143* (2013.01); *E04D 5/145* (2013.01); *E04D 5/146* (2013.01); *E04D 11/02* (2013.01); *E04D 13/00* (2013.01); *E04D 15/04* (2013.01); *E04D 2015/045* (2013.01)

(58) Field of Classification Search

CPC ..... E04D 3/3605; E04D 3/3606; E04D 3/00; E04D 3/02; E04D 3/16; E04D 5/148; E04D 5/145; E04D 5/146; E04D 11/02

USPC ..... 52/408, 409, 58–62

See application file for complete search history.

(56) References Cited

U.S. PATENT DOCUMENTS

| | | | | |
|---|---|---|---|---|
| 1,965,972 | A | 7/1934 | Balph | |
| 2,122,747 | A | 7/1938 | Lester | |
| 4,233,791 | A | 11/1980 | Kuhl | |
| 4,346,543 | A | 8/1982 | Wilson | |
| 4,382,353 | A * | 5/1983 | Kelly | E04D 1/365 52/309.5 |
| 4,570,396 | A * | 2/1986 | Struben | E04B 7/00 52/199 |
| 4,736,552 | A | 4/1988 | Ward | |
| 4,864,781 | A * | 9/1989 | Emblin | E04D 3/38 52/404.3 |
| 5,365,709 | A | 11/1994 | Lassiter | |
| 5,367,848 | A | 11/1994 | McConnohie | |
| 5,479,753 | A | 1/1996 | Williams | |
| 6,050,042 | A | 4/2000 | Durachko | |

(Continued)

*Primary Examiner* — Brian E Glessner
*Assistant Examiner* — Adam G Barlow
(74) *Attorney, Agent, or Firm* — Jennifer Meredith, Esq.; Lippes, Mathias, Wexler, Friedman, LLP

(57) ABSTRACT

A roofing system, comprising: at least one strap spaced on centers horizontally up the slope of a roof deck; at least one bead of adhesive applied to the at least one strap; at least two metal roofing panels placed on the at least one bead of adhesive applied to the at least one strap; and at least two fasteners attached to the at least two metal roofing panels and into the roof deck at a top and perimeter of the at least two metal roofing panels.

17 Claims, 8 Drawing Sheets

(56) References Cited

U.S. PATENT DOCUMENTS

| | | | | |
|---|---|---|---|---|
| 6,250,036 | B1 * | 6/2001 | Nurley | E04D 3/3606 52/408 |
| 6,454,889 | B1 | 9/2002 | Hendrix | |
| 7,987,647 | B2 * | 8/2011 | Rymell | E04D 3/3608 52/408 |
| 8,024,906 | B1 | 9/2011 | Nelson | |
| 2002/0170254 | A1 | 11/2002 | Ritland | |
| 2003/0070391 | A1 | 4/2003 | Tachauer | |
| 2004/0003563 | A1 | 1/2004 | Burdic | |
| 2005/0097828 | A1 | 5/2005 | Hasse | |
| 2006/0096218 | A1 | 5/2006 | Johnson | |
| 2007/0266660 | A1 | 11/2007 | Davies | |
| 2008/0028708 | A1 | 2/2008 | Albora | |
| 2009/0107073 | A1 | 4/2009 | Kalkanoglu | |
| 2009/0255201 | A1 | 10/2009 | Kraus | |
| 2009/0293375 | A1 | 12/2009 | Schroer | |
| 2011/0146199 | A1 | 6/2011 | Ferrante | |
| 2012/0045623 | A1 | 2/2012 | Delaney | |
| 2012/0096791 | A1 | 4/2012 | Cashin | |
| 2012/0233949 | A1 * | 9/2012 | Brannon | E04D 3/3602 52/410 |

* cited by examiner

LOW SLOPE ROOFING SYSTEM

The present invention relates to low slope roofing systems and low slope single ply roofing systems.

Aspects of the present invention includes the Stealth Anchor and the Stealth Bond. The present application is directed to the Stealth Bond. The "Stealth Anchor" is a low Slope Roofing Fastening System. The "Stealth Bond" is a metal roofing adhesive fastening system. Low Slope Roofing is less than 2/12 to flat built up roofing. The prior art utilizes strapping in tension with fasteners placed perpendicular in shear. Both the "Stealth Anchor" and the "Stealth Bond" systems utilize the straps surface area in adhesive for tension, with the fasteners in withdrawal and not in shear. This is one of the advances in the present invention.

The Stealth anchor product would be utilized in lieu of the screw attached 6" metal plates which are the current industry attachment method. The present invention may provide a continuous Gun Nailed Anchor Strapping System for concealed Surface Area Adhesion Connections. For Surface area adhesive structural attachment of Peel & Stick underlayment to decking thru 30# roll felt for modified ply torch down, modified bitumen membrane Low Slope roll roofing Applications. A Continuous Roll Strapping distribution hand cart for automatic gun nail attachment is recommended. This super-efficient product is utilized in lieu of the screw attached 6" metal plates which is the current industry method. For the truss attachment, ring shank nails may be a minimum of 1¾". A Continuous Roll Strapping distribution hand cart for automatic gun nail attachment is recommended. A continuous Roll would weigh approx. 150'=37.045#, 200'=49.393# and 250'=61.742#.

The Stealth Bond is a metal roofing adhesive fastening system. Again, the prior art utilizes strapping in tension with fasteners placed perpendicular in shear. The Stealth Bond system utilizes the same Stealth Anchor straps surface area in adhesive for tension, with the fasteners in withdrawal and not in shear. This is a patentable difference plus the fact that the Stealth Bond system utilizes foam adhesive to bond metal roofing for greater than 2/12 slopes to the Stealth Anchor. According to one embodiment, 3M's CR-20 low rise adhesive could be used or also their AH-160 Foam adhesive or ADCO Korapur 125 one part synthetic moisture-triggered polyurethane or a Korapur 330 two part synthetic epoxy-triggered adhesive to attach metal roofing to the Stealth Anchor Strap. This type metal roofing application has never been conceived or accomplished until the present invention. Attached are pictures, FIGS. 3 and 4 depict concealed continuous strapping, gun nailed to decking providing an efficient structural anchor surface area for adhesive attachment of metal roofing panels.

The invention provides an innovative metal roofing concealed adhesive attachment concept. The process may be to gun nail 1½" to 4" knurled 25 ga. Steel strapping with ring shank roofing nails on 6 to 8" on center, OC, along the length of the straps that are spaced 16" to 24" on centers horizontally up the slope of the roof deck, as depicted in FIG. 5. Then applying beads of tube or foam adhesive onto the strapping and positioning metal roofing panels over and then only screwing the panels to the deck at the top and perimeter. Z closure type concealed fasteners may be be utilized for the trims. The Strapping would provide an adequate surface to effectively adhere the metal roofing panels to the roof. This is truly a unique industry precedence setting innovation never before accomplished. The "Stealth Bond" provides a means for previously exposed screw fastened metal roofing panels to be structurally attached by concealed adhesives and strapping beneath the panel eliminating the thousands of metal roofing surface penetrating screw type fasteners.

BRIEF SUMMARY OF THE INVENTION

The present invention provides a roofing system, comprising: at least one strap spaced on centers horizontally up the slope of a roof deck; at least one bead of adhesive applied to the at least one strap; at least two metal roofing panels placed on the at least one bead of adhesive applied to the at least one strap; and at least two fasteners attached to the at least two metal roofing panels and into the roof deck at a top and perimeter of the at least two metal roofing panels.

DETAILED DESCRIPTION OF THE INVENTION

Figure 1:
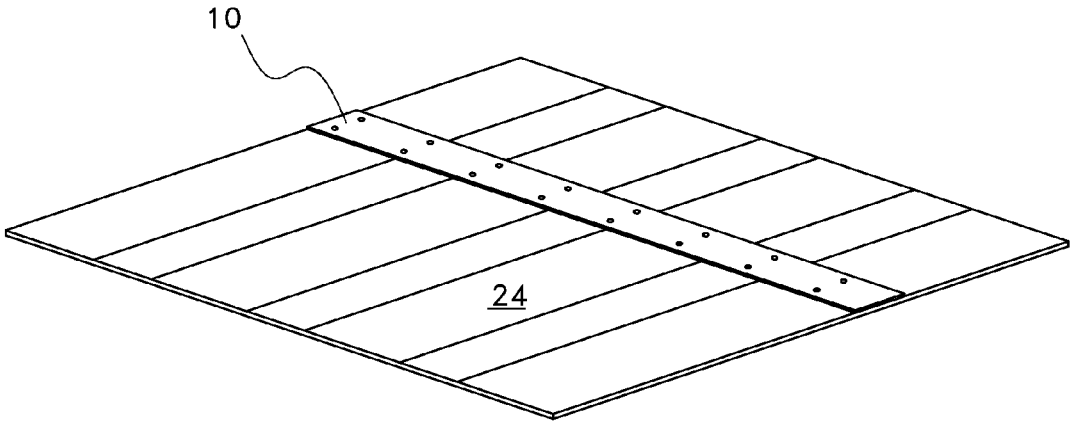
FIGS. 1 and 2 depict the Stealth anchor installation.
Figure 2:
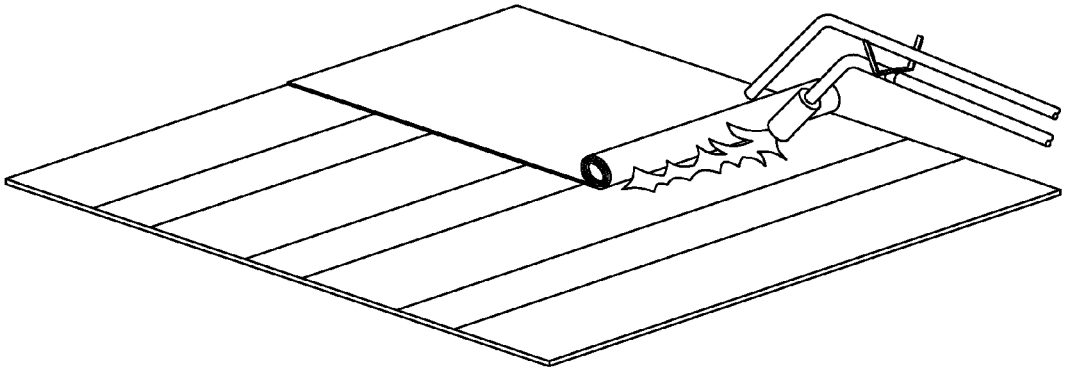
Figure 3:
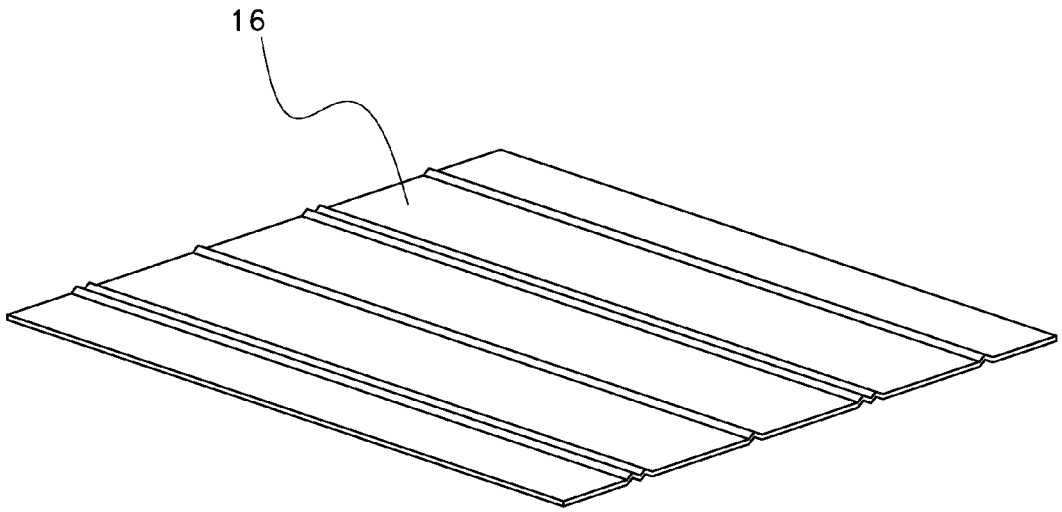
FIGS. 3 and 4 depict concealed continuous strapping gun nailed to decking providing an efficient structural anchor surface area for adhesive attachment of metal roofing panels.
Figure 4:
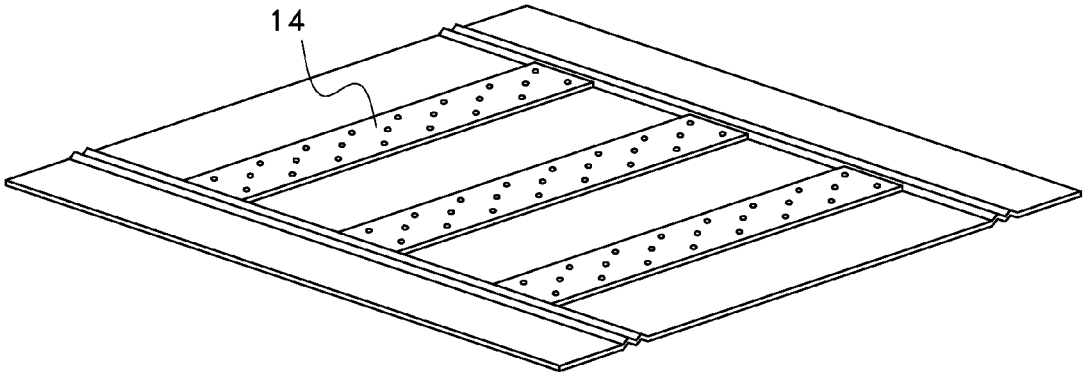

The present invention provides a roofing system, comprising: at least one strap (10) spaced on centers horizontally up the slope of a roof deck (12); at least two fasteners (18) attached to the at least one strap and into the roof deck; at least one bead of adhesive (14) applied to the at least one strap; and at least two metal roofing panels (16) placed on the at least one bead of adhesive applied to the at least one strap. The at least one strap (10) spaced on centers horizontally up the slope of a roof desk may be steel strapping. The at least one strap may be tensile steel with a corrosion resistant barrier coating. The at least one strap may also be rolled tensile steel. That is to say it may be in a continuous roll form. The at least one strap may be perpendicular to the length of the underlayment layer and spaced a predetermined length on center. For example, the at least one strap (10) may be an anchor seam roll that is 4" wide and Galvalume™ Grade 50 steel. The strap may be an anchor seam roll that may also be, for example, 29 ga. ASTM A 792, Grade 80 Class 1 Approved SS, AZ50 with a width between 1.9 and 4.1 inches and a thickness between 0.014 and 0.016 inches or 26 ga. ASTM A 792, CS Type B, AZ50 with a width between 1.9 and 4.1 inches and a thickness between 0.017 and 0.020 inches. The anchor seam roll may be a Galvalume™ carbon acrylume ASTM A792-10 approved CS type B as coated C 0.02/0.15 mn 0.60 max P 0.30 max S 0.035 max CU 0.25 max NI 0.20 Max CR 0.15 Max MO 0.6 max V 0.008 Max Ti 0.025 Max CB 0.008 Max with the exposed prime side out and AZ50 clear organic surface treatment with dry pickle welds. According to the chemical analysis in weight % of one specimen, C=0.05, MN=0.27, P=0.006, S=0.009, SI=0.014, CU=0.01, NI=0.00, CR=0.03, MO=0.011, SN=0.008, AL=0.032, N=0.005, V=0.001, B=0.0003, TI=0.001 and CB=0.001. According to another embodiment, the anchor seam roll may be a Galvalume™ carbon acrylume ASTM A792-10 approved CS type B as coated C 0.02/0.15 mn 0.60 max P 0.30 max S 0.035 max CU 0.25 max NI 0.20 Max CR 0.15 Max MO 0.6 max V 0.008 Max Ti 0.025 Max CB 0.008 Max with the exposed prime side out and AZ50 clear organic surface treatment with dry pickle welds. According to the chemical analysis in weight % of one specimen, C=0.05, MN=0.31, P=0.011, S=0.014, SI=0.015, CU=0.04, NI=0.01, CR=0.06, MO=0.008, SN=0.011, AL=0.040, N=0.004, V=0.002, B=0.0003, TI=0.001 and CB=0.001. According to yet another embodiment, the anchor seam roll may be a Galvalume™ carbon acrylume ASTM A792-10 Grade 80 class 1 approved SS AS coated C 0.20 max mn 1.35 max P 0.04 max S 0.040 max CU 0.25 max NI 0.20 Max CR 0.15 Max MO 0.6 max V 0.008 Max Ti 0.025 Max CB 0.015 Max with the exposed prime side out and AZ50 clear organic surface treatment with dry pickle welds. With ok-limit 1 ys min 80 ksi 0.2% offset is min 82 ksi el dist 2 inches longitudinal ASTM std tens. According to the chemical analysis in weight % of one specimen, C=0.05, MN=0.31, P=0.006, S=0.012, SI=0.008, CU=0.03, NI=0.01, CR=0.05, MO=0.020, SN=0.004, AL=0.035, N=0.008, V=0.001, B=0.0003, TI=0.001 and CB=0.009 and SB=0.001.

Figure 7:
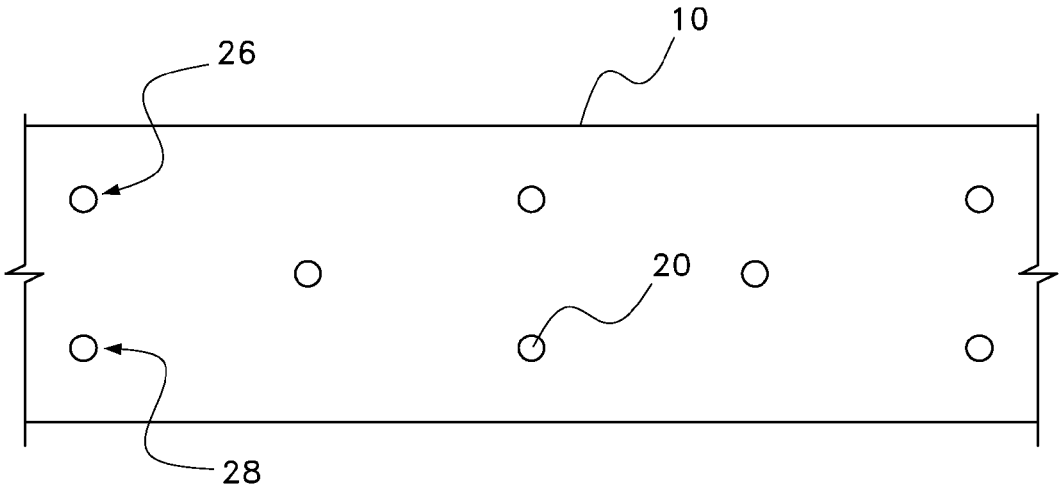
FIG. 7 depicts a Stealth Bond strap with fastening.
Figure 8:
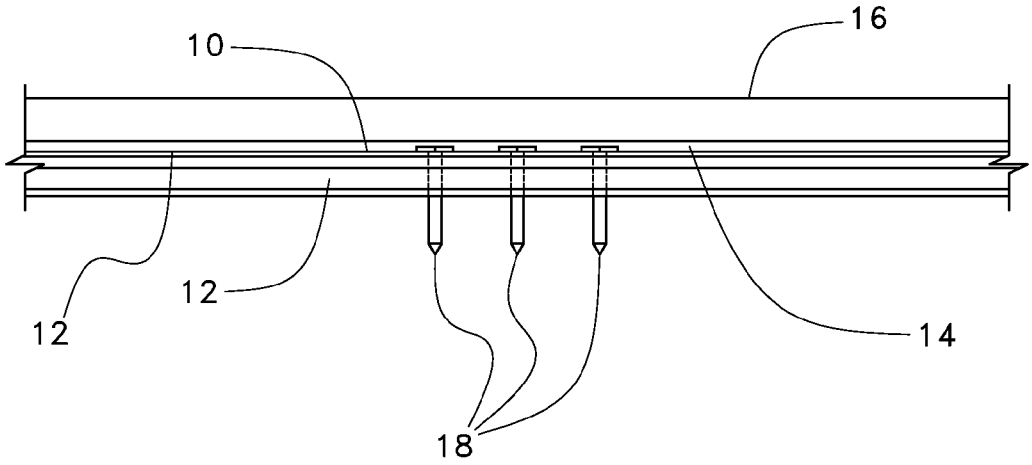
FIG. 8 depicts a Stealth Bond metal roofing adhesive.
Figure 9:
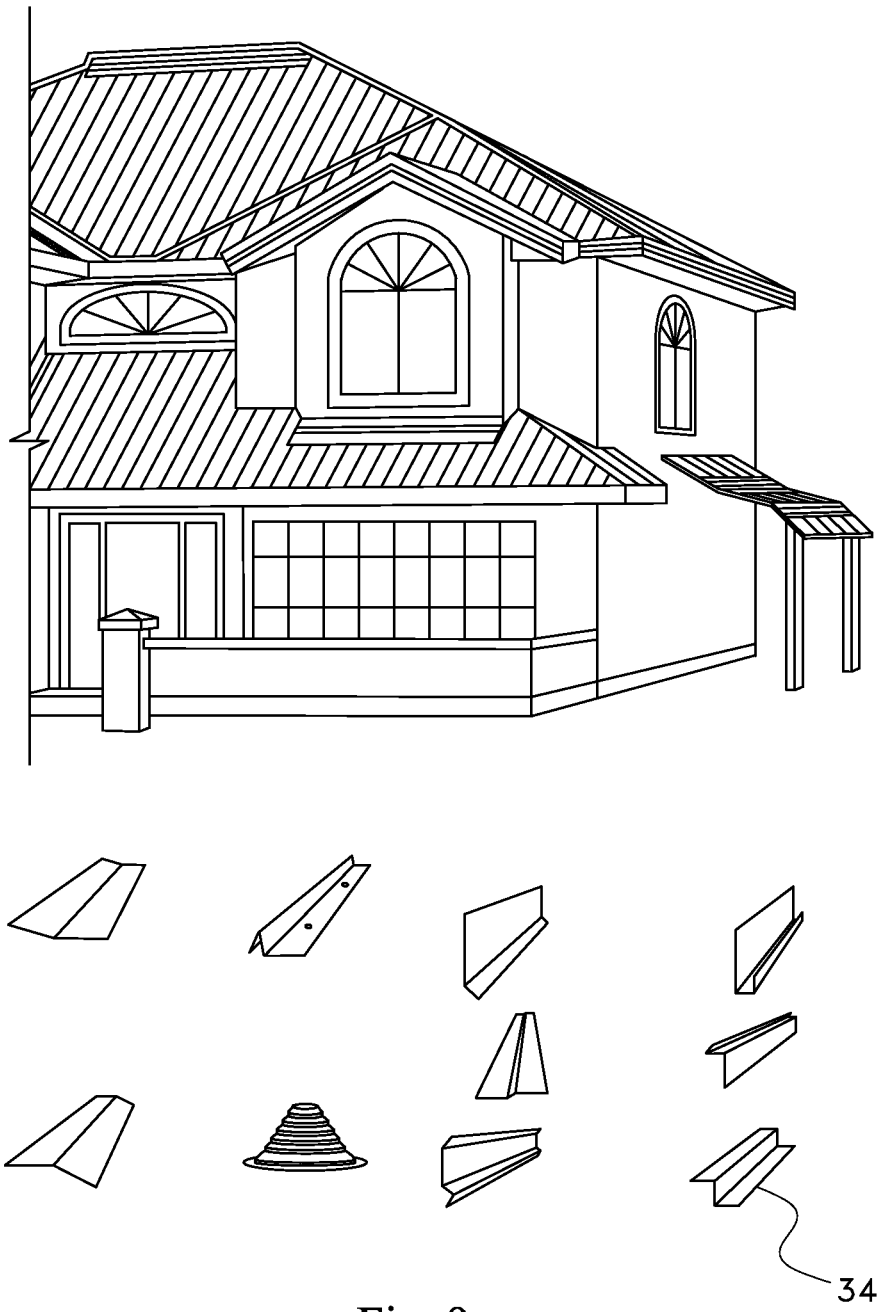
FIGS. 9 and 10 depicts a Z closure type concealed fasteners.
Figure 10:
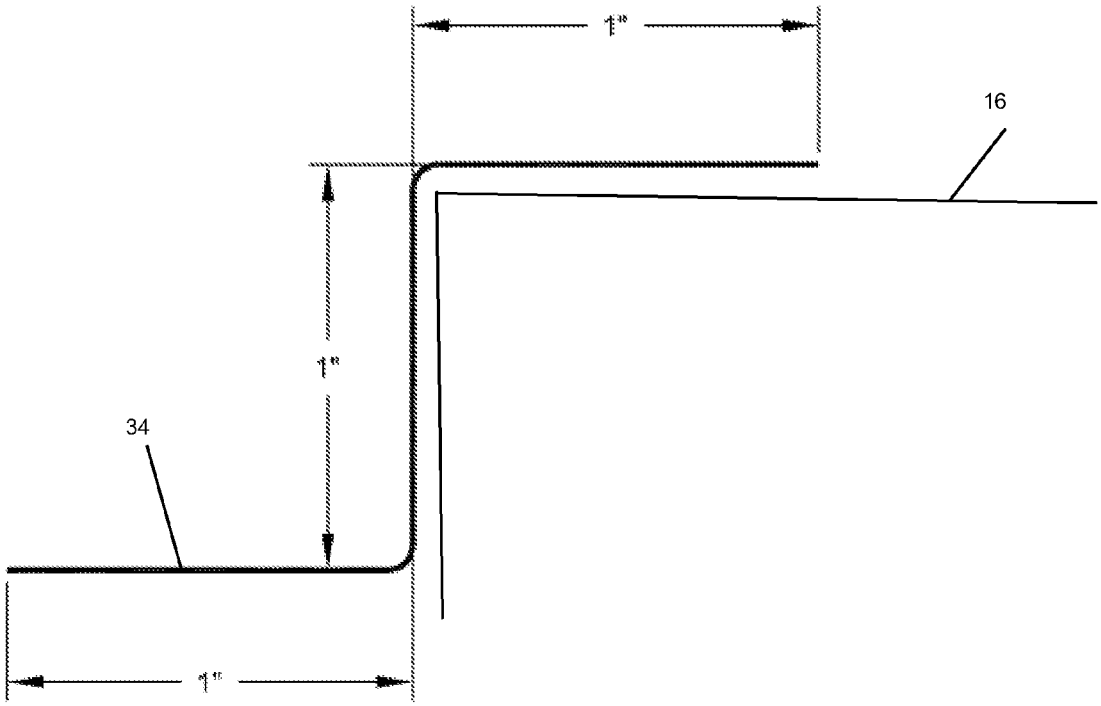

As shown in FIG. 7, the at least one strap (10) may be spaced on centers horizontally up the slope of a roof desk and attached with ring shank roofing nails (20). The ring shank roofing nails may be between 6 and 8 inches on center. The at least one strap may be spaced between 12", 16" and 24" inches on centers horizontally up the slope of the roof deck. There may be trim along at least one edge of each of the at least two metal roofing panels, wherein the trim is attached along the at least one edge of each of the at least two metal roofing panels by a Z closure type concealed fasteners. FIG. 9 depicts a Z closure type concealed fastener (34). As shown in FIG. 1, the at least one strap (10) may have a length that is positioned perpendicular to the length of a base sheet (24) and spaced at a predetermined length on center. Each of the at least one straps (10) may be attached by at least two fasteners placed in two rows (e.g. 26 and 28) at a predetermined length on center along the strap. At least one of the two rows (e.g. 26 and 28) of fasteners is fastened into a wood support (12) of the roof deck. The at least two fasteners may be in withdrawal and not in shear. According to one embodiment, 29 ga. Anchor straps were spaced 24 inches on center and attached perpendicular to the wood supports with 12 ga. 1¼" ring shank nails. The nails were installed in three, equally spaced staggered rows 6" o.c. and 1" from the strap edge. The 5-V crimp panels were adhered to each strap in a continuous ⅜" wide bead of Silaprene SolidSeal. The perimeter of the specimen was attached with #10-14×1½" HWH wood screws spaced 6" o.c.

There may be underlayment layer under the at least one strap and above the roof deck. The terms base sheet and underlayment layer are interchangeable. The adhesive (14) may be a urethane adhesive and sealant. The adhesive may be a foam adhesive.

Figure 5:
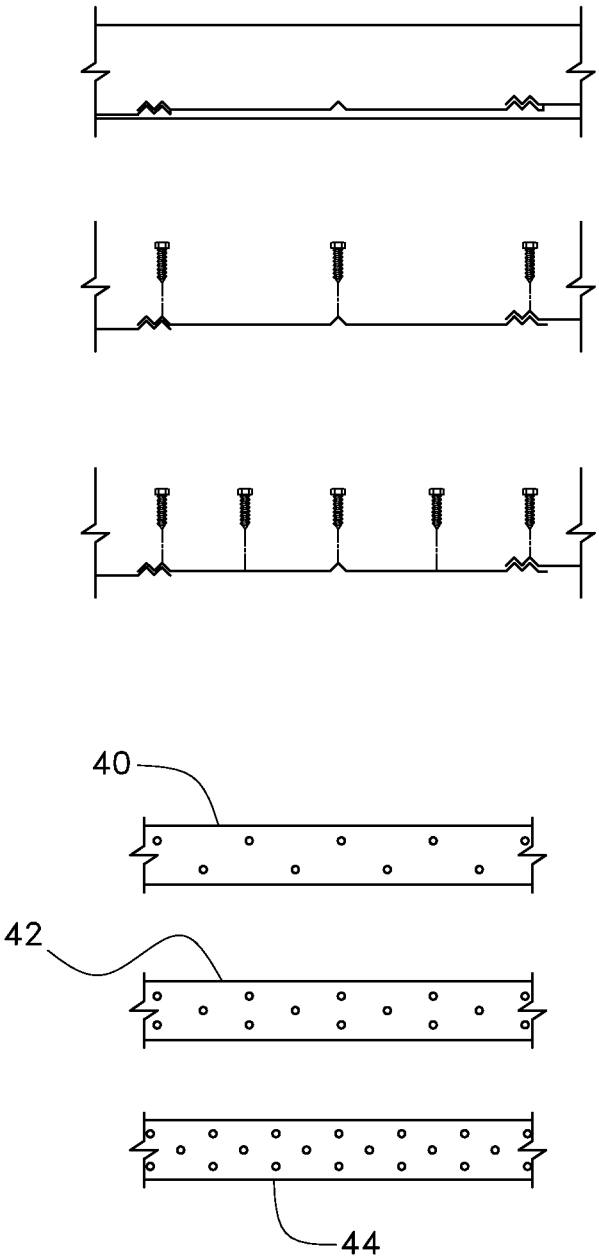
FIG. 5 depicts steel strapping with ring shank roofing nails on 6 to 8" on center, OC, along the length of the straps that are spaced 16" to 24" on centers horizontally up the slope of the roof deck.
Figure 6:
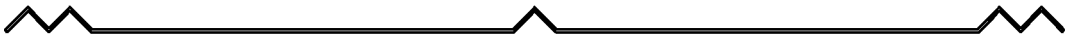
FIG. 6 depicts a 5 V crimp profile metal roofing panel.

The present invention utilizes a larger flat surface area for superior adhesion of single ply roofing system materials. The present invention utilizes rolls that are designed for use with 1¼" Ring Shank Roofing Gun Nails fasteners when mechanically attaching a single-ply roofing membrane to wood structural decks. It is easy-to roll for improved installation efficiency. the at least one strap has markings to designate a gun nail on center fastener target locations. The at least one strap has markings to designate a gun nail on center fastener target locations. FIG. 5 depicts three examples of markings on straps (40, 42 and 44). The anchor rolls may have 6-inch on center fastener location marking. A dispensing handle promotes each handling and unrolling. The Stealth anchor roll lays flat beneath the roofing membrane without wrinkles and eliminates the need to measure for accurate fastener placement. The continuous seam roll remains straight and spaced correctly for improved installation productivity. Unwinding the seam roll cuts labor when compared to individually shuffling and placing plates. Seam roll reel installation is more ergonomically friendly. To install, the at least one strap is an anchor seam roll which is positioned at the edge of the membrane. A first end is secured in position over the center of the top rib in the deck. The reel is walked along the edge of the roofing membrane dispensing the seam roll. At the end of each row, the roll is fastened in place. Roofing gun nail type fasteners are used to mechanically attach single-ply low slope roofing systems on a variety of deck types. The fasteners are attached and the anchor seam roll is unrolled along the roof membrane lap seam for proper fastener spacing. At the end of the run, the anchor seam roll is cut and the process repeated. The present invention provides a means for previously exposed screw fastened metal roofing panels to be structurally attached by concealed adhesive and base anchor connector beneath the panel eliminating thousands of metal roofing surface penetrating screw type fasteners. The system utilizes a base anchor connector's surface area for a permanent polyurethane adhesive to bond metal roofing panel systems to the roof deck. A concealed continuous anchor connector may be gun nailed to decking to provide an efficient structural anchor surface area for adhesive attachment of metal roofing panels. The system provides contractors with continuous base anchor attachment in lieu of exposed thru panel screws or clips to attach metal roofing panels systems to roof decks. The system adheres to most metal roofing panel systems, the base anchor connector includes fastener location markings. If a one-component urethane adhesive is utilized it fully cures with air within 24 hours. It may be permanently flexible to withstand movement of up to 450% of expansion and contraction with the tensile strength of the adhesive being approximately 288 psi. The system eliminates all field exposed metal roofing screws, dramatically cuts metal roofing installation time and expensive labor, eliminates the need to measure for accurate screw fastener placement, joins the metal roofing panel system material within 10 minutes, reduces corrosive staining screw shavings to sweep off, reduces the effects of cross panel tensioning (oil canning) and allows metal roofing to lay flat without screw fastener dimpling.

It should be understood that the foregoing relates to preferred embodiments of the invention and that modifications may be made without departing from the spirit and scope of the invention as set forth in the following claims.

I claim:

1. A roofing system, comprising:

at least two straps extending horizontally and spaced from each other in a direction up the slope of a roof deck;

at least two nail fasteners attached to the at least one strap and into the roof deck, wherein a head of each of the nail fasteners is above at least one strap and a shaft of each of the nail fasteners is driven through the strap and into the roof deck;

at least one bead of adhesive applied above the at least one strap; and at least two metal roofing panels placed on the at least one bead of adhesive applied above the at least one strap, wherein the at least two metal roofing panels are above the at least two nail fasteners and the at least two nail fasteners do not penetrate the at least two metal roofing panels.

2. A roofing system as in claim 1, wherein the at least one strap spaced horizontally up the slope of a roof desk is steel strapping.

3. A roofing system as in claim 1, wherein the at least one strap spaced horizontally up the slope of a roof deck is attached with ring shank roofing nails.

4. A roofing system as in claim 3, wherein the ring shank roofing nails are between 6 and 8 inches on center.

5. A roofing system as in claim 1, wherein the at least one strap is at least two straps that are spaced between 16 and 24 inches on centers horizontally up the slope of the roof desk.

6. A roofing system as in claim 1, further comprising trim along at least one edge of each of the at least two metal roofing panels, wherein the trim is attached along the at least one edge of each of the at least two metal roofing panels.

7. A roofing system as in claim 1, further comprising an underlayment layer under the at least one strap and above the roof deck.

8. A roofing system as in claim 1, wherein the at least one strap has a length that is positioned perpendicular to a length of a base sheet and spaced at a predetermined length on center.

9. A roofing system as in claim 1, wherein at least one strap is attached by at least two fasteners placed in two rows at a predetermined length on center along the strap.

10. A roofing system as in claim 9, wherein at least one of the two rows of fasteners is fastened into a wood support of the roof deck.

11. A roofing system as in claim 1, wherein the adhesive is a urethane adhesive and sealant.

12. A roofing system as in claim 1, wherein the at least two fasteners are in withdrawal and not in shear.

13. A roofing system as in claim 1, wherein the at least one strap is tensile steel with a corrosion resistant barrier coating.

14. A roofing system as in claim 7, wherein the at least one strap is at least two straps placed perpendicular to a length of the underlayment layer and spaced a predetermined length on center.

15. A roofing system as in claim 1, wherein the adhesive is a foam adhesive.

16. A roofing system as in claim 1, wherein the at least one strap is rolled tensile steel.

17. A roofing system as in claim 1, wherein the at least one strap has markings to designate a gun nail for nailing on center fastener target locations.

* * * * *